US005194042A

United States Patent [19]

Clark

[11] Patent Number: 5,194,042

[45] Date of Patent: Mar. 16, 1993

[54] LINEAR SLOT DIFFUSER

[75] Inventor: Shenandoah S. Clark, Sanford, Fla.

[73] Assignee: Metal Manufacturing Co., Sanford, Fla.

[21] Appl. No.: 698,995

[22] Filed: May 13, 1991

[51] Int. Cl.[5] ..... F24F 13/072

[52] U.S. Cl. ..... 454/304

[58] Field of Search ..... 98/40.12, 40.14, 40.17, 98/41.1, 42.02, 42.12

[56] References Cited

U.S. PATENT DOCUMENTS

| | | | |
|---|---|---|---|
| 2,224,312 | 12/1940 | O'Day | 98/41.1 |
| 3,126,811 | 3/1964 | Kennedy | 98/40.17 |
| 3,185,068 | 5/1965 | Straub et al. | 98/40.17 |
| 3,185,069 | 5/1965 | Straub et al. | 98/40.17 |
| 3,308,744 | 3/1967 | Schach | 98/40.17 |
| 3,353,473 | 11/1967 | Oneson et al. | 98/40.16 |
| 3,412,669 | 11/1968 | Averill | 98/40.17 |
| 3,584,565 | 6/1971 | Bush | 98/41.2 X |

FOREIGN PATENT DOCUMENTS 1514459 6/1978 United Kingdom .

*Primary Examiner*—Harold Joyce

*Attorney, Agent, or Firm*—Allen, Dyer, Doppelt, Franjola & Milbrath

[57] ABSTRACT

A linear slot diffuser for distributing air from a duct into or out of a room. The diffuser includes a frame forming a channel with a plurality of spaced plastic or vinyl supports disposed therein. The supports allow controller blades to be easily positioned in different angular arrangements to change the direction of air flow. The supports are preferably constructed with a plastic or vinyl material and function as a bearing surface.

13 Claims, 1 Drawing Sheet

LINEAR SLOT DIFFUSER

BACKGROUND OF THE INVENTION

This invention relates to diffusing devices for controlling the flow and direction of air into a room from an air duct. More particularly, the invention relates to a linear slot diffuser that reduces rattle noise when the air is controlled as it flows in the room.

Air distribution devices, also referred to as diffusers, are typically set into the ceiling or other walls in a room and receive conditioned air along its length from a supply duct. These devices have elongated narrow slots, each of which is opened across its full width and enclosed by a frame. An extruded member which is within the slots and attached to the frame holds one or more vanes. The vanes are mounted to the support member with hinges or resistance so that their orientation may be altered to vary the direction of air flowing through the distribution device.

Examples of prior distribution devices are described in U.S. Pat. Nos. 3,126,811, 3,185,068 and 3,185,069 and in British Patent No. 1,514,459. Other examples of slot diffusers are manufactured by Titus Corp. of Richardson, Tex.; Metal Industries Inc. of Clearwater, Fla. and J and J, Inc. of El Paso, Tex. These patents and products all have the aforementioned features with structural differences present mainly in the shape of the frame or the vane.

The vanes, frames and support members of the prior art air distribution devices are constructed from metal to provide rigidity and stability when air flows through the device at a high rate. Stability is necessary to prevent a change in vane orientation while air is being directed at various angles into (or out of) the room. A drawback to these devices is that when air flows across the vane, the vane frequently vibrates because of the metal-to-metal contact between the vane and support member. The vibration may result in unwanted rattling. Another drawback to prior art devices is that this vibration may be propagated through the device to the support member to cause rattle.

SUMMARY OF THE INVENTION

An objective of this invention is to provide an improved linear slot diffuser.

Another objective of this invention is to pass air through a slot diffuser having a vane that controls the direction of flow and quantity of air while reducing rattle due to vane vibration.

An additional objective of this invention is to support a vane in a linear slot diffuser with a material that prevents rattle and vibration when air passes through the diffuser into or out of a room.

These and other objectives are accomplished with a linear slot diffuser comprising a frame having a channel disposed therein through which air passes. A vane is disposed in the channel for directing the flow and quantity of air as the air enters and/or exits the diffuser. A support member means is coupled to the housing for holding the vane in place within the channel. The support means is constructed from a flexible material to prevent rattle in the diffuser due to air passing across the vane at a high rate of flow.

Alternately, a linear slot diffuser is provided for controlling the flow of air into or out of a room. The diffuser comprises a frame having opposingly facing longitudinally extended parallel walls adjacent one end. The frame has an opening at one end in which air enters or exits the channel and a slot at the other end in which air exits or enters the channel and flows into or out of the room. The diffuser includes a flexible support member, preferably plastic or vinyl, extending between the walls and being disposed within the channel adjacent one end. A deflector vane is disposed within the channel and extending along the slot. The vane is hingedly attached at one end to the support members so that the vane's orientation may be changed to alter the direction of air exiting from or entering into the housing. The deflector vane contacts the plastic support member to reduce rattle resulting from air in the channel flowing across the vane.

DESCRIPTION OF THE PREFERRED EMBODIMENTS

Figure 1:
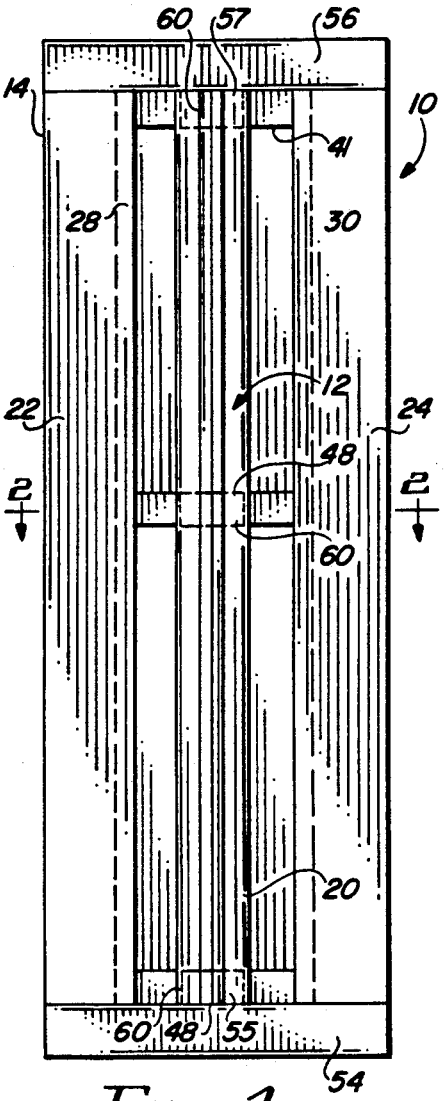
FIG. 1 is a bottom plan view of the linear slot diffuser embodying the invention.

Referring to FIGS. 1 through 4, there is shown a linear slot diffuser 10 for controlling the flow of air flowing into (or out of) room 11. The downstream portion of the diffuser has an elongated air discharge slot 12 from which air exits (or enters) diffuser 10. Diffuser 10 comprises frame 14 having two parallel side walls 16 and 18 opposingly facing each other and forming air channel 20 between side walls 16 and 18 It is preferable that frame 14 be constructed from metal extrusions.

Side walls 16 and 18 have flanges 22 and 24, respectively, formed as an integral part of the extrusion along the edge of respective side walls 16 and 18. When diffuser 10 is inserted and mounted into a slot into ceiling 26 or walls 16 and 18, flanges 22 and 24 on frame 14 contact ceiling 26 or walls 16 and 18 adjacent to the slot therein. Duct 13 surrounds a top portion of frame 14.

Walls 16 and 18 have on their edge narrow longitudinal flanges 28 and 30 substantially coextensive with slot 12. Flanges 28 and 30 are directed inward into channel 20. Flanges' 28 and 30 upper surfaces are near the mouth of channel 20 and are set at right angles to the air stream in the channel thus forming a narrow air-deflecting surface. Air that flows through channel 20 near respective walls 16 and 18 is deflected by flanges 28 and 30 into a lateral flow path (shown by arrows in FIGS. 2 and 3).

Walls 16 and 18 respectively, have opposingly facing longitudinal flanges 32 and 34, 36 and 38, and 40 and 42 near the edges thereof, which are respectively formed as an integral part of the extrusion along the edge of respective side walls 16 and 18. Flanges 32–42 form two adjacent tracks 44 and 46 in side walls 16 and 18.

Disposed within track 44 is a plurality of webs 48 which are spaced within frame 14 at each end of slot 12, one of webs 48 is disposed in substantially the center of slot 12. Screws 50 and 52 are inserted through walls 16 and 18, respectively, and into each end of web 48. Web 48 provides a support means for holding walls 16 and 18 together and in place. Web 48 is preferably constructed from a metal material to maintain rigidity during slot usage.

Located at each end of slot 12 are end caps 54 and 56. End caps are formed to surround both walls 16 and 18 and flanges 22, 24, 28 and 30. End caps 54 and 56 have flat walls 55 and 57, respectively, bordering channel 20 adjacent the ends of walls 16 and 18 to direct air out or into slot 12.

Referring to FIGS. 2-5, positioned within track 46 and extending across walls 16 and 18 is vane support member 60. Vane support member 60 hingedly supports vanes 66 and 68. Vane support member 60 includes a vertical section 61 and a horizontal section 59. Horizontal section 59 bisects vertical section 61 on each end of horizontal section 59. It is critical that this vane support member 60 be constructed from a flexible material such as plastic or vinyl at the location where vanes 66 and 68 contact support member 60. This flexible material is defined as a non-metal resilient material or a resilient coating. Vane support member 60 is held in place within track 46 and is disposed within slots 12 at locations below web 48 downstream of respective side walls 16 or 18. Vane support member 60 has a plurality of flaps 62 and 64 extending along its down air surface parallel to slot 12. Flaps 62 and 64, along with the surface of member 60, hold deflector vanes 66 and 68.

Figure 5:
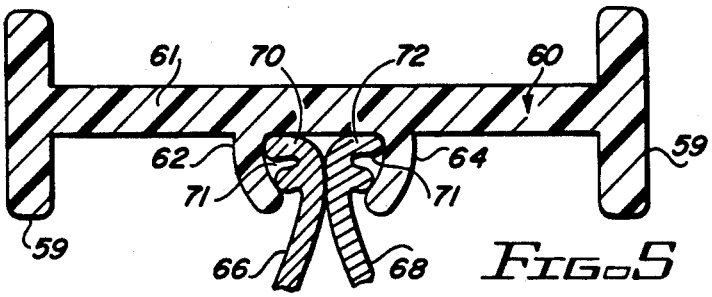
FIG. 5 is a cross-section view of the vane support member and the vane shown in FIG. 2, showing the connection between the same.

Referring to FIG. 5, deflector vanes 66 and 68 are preferably constructed with a metal material and have flanges 70 and 72 on each respective ends thereto. Flanges 70 and 72, shaped circular in cross-section, contact each other, flaps 62 and 64 and horizontal section 59 of vertical support member 60. Extending longitudinally through flanges 70 and 72 is groove 71. Integrally coupled to vanes 66 and 68 are flaps 76 and 78 which permit adjustments to vanes' 66 and 68 orientation to be made with a screwdriver or other suitable tool. Vanes 66 and 68 are oriented so as to be adjustable within support member 60 and flaps 62 and 64 to control the direction of air flowing through channel 20.

Figure 2:
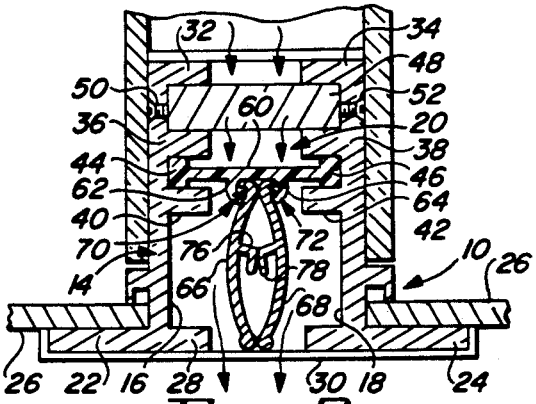
FIG. 2 is a cross-section view taken along section 2—2 of FIG. 1 showing the positioning of the vanes in the air channels in a vertical air discharge pattern.
Figure 3:
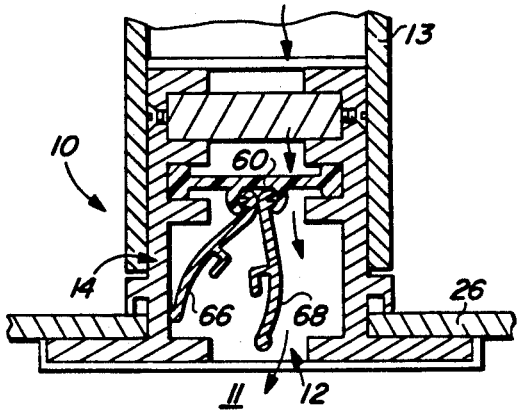
FIG. 3 is a cross-section view of the linear slot diffuser shown in FIG. 1 taken along section 2—2 of FIG. 1 showing the positioning of the air vanes in a horizontal discharge pattern.
Figure 4:
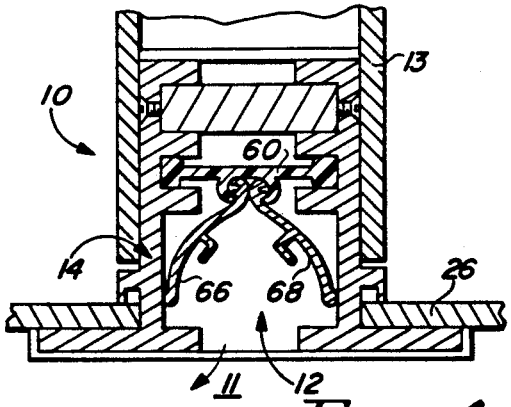
FIG. 4 is a cross-section view of the linear slot diffuser shown in FIG. 1 taken along section 2—2 of FIG. I showing the positioning of the air vanes in a blocked air discharge pattern.

Referring to FIG. 2, there is disclosed vanes 66 and 68 oriented in a downward position. This downward orientation maximizes air flow downward through channel 20 and into the room below. In FIG. 3 there is shown air flowing downward through channel 20 and being directed downward out one side of channel 20 into the room below. The positioning of vanes 66 and 68, as shown in FIG. 3, results in air flowing through channel 20 sideways into the room below. FIG. 4 discloses diffuser 10 with vanes 66 and 68 in an outward extending position to prevent any air from flowing through channel 20 into the room below.

It is recognized that by constructing vane support member 60 from a plastic or vinyl material, or by constructing vane support member 60 such that it has a layer of plastic or vinyl on support member's 60 surface contacts vanes' 66 and 68 vibration and rattle are reduced when air flows over deflector vanes 66 and 68 out slot 12 and into the room below.

This concludes the description of the preferred embodiments. A reading by those skilled in the art will bring to mind various changes without departing from the spirit and scope of the invention. It is intended, however, that the invention only be limited by the following appended claims.

What is claimed is:

1. A linear slot diffuser for controlling flow of air in a room, the diffuser comprising:

a frame having opposingly facing, longitudinally extending parallel walls forming a channel therebetween, said frame having an opening at one end in which air enters or exits said channel and a slot at the other end in which air exits or enters said channel and flows into or out of the room;

means including a flexible plastic vane support member extending between said walls and being disposed within said channel;

a structural web rigidly fixed to the walls and extending across the channel and spaced from the vane support member; and a deflector vane disposed within said channel and extending along said slot such that air in said channel flows across said vane, said deflector vane being hingedly supported on one of its ends by said flexible material on said support member to change the orientation of said deflector vane to alter the direction of air exiting said channel and reduce rattle due to air in said channel flowing across said vane.

2. The diffuser as recited in claim 1 further comprising a second deflector vane disposed within said channel and extending along said first deflector and along said slot, said first and second vanes being hingedly supported adjacent one of its ends by said support member so that said vane's orientation may be changed to change the direction of air exiting said channel, and said second deflector vane contacting said plastic support member to dampen vibration resulting from air in said channel flowing across said second vane.

3. The diffuser as recited in claim 2 wherein said second deflector vane contacts said first deflector vane adjacent the ends of the first and second deflector vanes where said first and second deflector vanes contact said support member.

4. The diffuser as recited in claim 1 further comprising track means extending along each of said walls in a direction parallel to said slot for guiding said support member so that the location of said support member within said channel can be adjusted.

5. The diffuser as recited in claim 4 further comprising a second track along each wall extending parallel to said first track.

6. The diffuser as recited in claim 4 wherein said support member extends between the track means along one said wall to the track means along the other facing wall.

7. The diffuser as recited in claim 1 further comprising means for mating with said vane support member comprising a flange on said hingedly supported end of said deflector vane.

8. A linear slot diffuser for controlling the flow of air into or out of a room, the diffuser comprising:

a frame having longitudinally extruding parallel walls forming a channel therebetween, said channel having an opening at one end in which air enters or exits said channel and a slot at the other end in which air exits or enters said channel and flows into or out of the room;

said walls forming a first and second opposingly facing tracks extending into the channel, said second track being positioned downstream from said first track in said channel;

means for holding said first wall in place adjacent said second wall comprising a plurality of webs disposed in said first track and attached to said walls in said first track;

a plurality of vane support members attached to said walls within said second tracks, and extending between said walls within said channel, each said support member having a first and second flap extending in a direction downstream and parallel to said slot along a surface of each said support member; and a plurality of deflector vanes disposed within said channel and attached at their ends to said support members between said flaps, said vanes extending along said slot such that air in said channel flows across said vanes, said vanes being hingedly coupled to said support member such that the deflector vanes orientation may be changed to alter the direction of air exiting said channel.

9. The linear slot diffuser as recited in claim 8 wherein said support member is constructed with a flexible material.

10. The linear slot diffuser as recited in claim 9 wherein said flexible material includes plastic.

11. The linear slot diffuser as recited in claim 8 further comprising means for attaching said web to said walls comprising a screw that extends through said wall and into said web.

12. The linear slot diffuser as recited in claim 8 wherein said vane support member comprises a horizontal section extending between the walls and a pair of vertical sections disposed on the ends of the horizontal section, said horizontal sections bisecting said vertical sections and extending perpendicular to said vertical sections.

13. The linear slot diffuser as recited in claim 8 wherein said deflector vanes contact each other adjacent the end of the deflector vane that contacts said support members.

* * * * *